US006684941B1

(12) United States Patent
Cao et al.

(10) Patent No.: US 6,684,941 B1
(45) Date of Patent: Feb. 3, 2004

(54) RECIPROCATING-MECHANISM DRIVEN HEAT LOOP

(76) Inventors: Yiding Cao, 16302 SW. 68 Ter., Miami, FL (US) 33193; Mingcong Gao, 9460 Fontainebleau Blvd., Apt. 225, Miami, FL (US) 33172

( * ) Notice: Subject to any disclaimer, the term of this patent is extended or adjusted under 35 U.S.C. 154(b) by 0 days.

(21) Appl. No.: 10/163,893

(22) Filed: Jun. 4, 2002

(51) Int. Cl.[7] ..... F28D 15/00
(52) U.S. Cl. ..... 165/104.25; 165/272; 165/104.26
(58) Field of Search ..... 165/104.25, 104.31, 165/104.34, 272

(56) References Cited

U.S. PATENT DOCUMENTS

| | | | | | |
|---|---|---|---|---|---|
| 3,517,730 | A | * | 6/1970 | Wyatt | 165/104.25 |
| 3,605,878 | A | * | 9/1971 | Coleman | 165/104.25 |
| 4,184,477 | A | * | 1/1980 | Yuan | 126/620 |
| 4,252,185 | A | * | 2/1981 | Kosson | 165/104.25 |
| 4,346,752 | A | * | 8/1982 | Kesten et al. | 165/104.12 |
| 4,441,548 | A | * | 4/1984 | Franklin et al. | 165/104.26 |
| 4,463,798 | A | * | 8/1984 | Pogson et al. | 165/1 |
| 4,683,940 | A | * | 8/1987 | Ernst et al. | 165/272 |
| 4,964,457 | A | * | 10/1990 | Leonard et al. | 165/272 |
| 4,986,348 | A | * | 1/1991 | Okayasu | 165/104.24 |
| 5,241,950 | A | * | 9/1993 | Mahdjuri-Sabet | 165/31 |
| 5,333,677 | A | * | 8/1994 | Molivadas | 165/272 |
| 5,394,936 | A | * | 3/1995 | Budelman | 165/104.33 |
| 5,771,967 | A | * | 6/1998 | Hyman | 165/104.26 |
| 5,911,272 | A | * | 6/1999 | Cornog et al. | 165/104.25 |
| 6,167,955 | B1 | * | 1/2001 | Van Brocklin et al. | 165/104.26 |
| 6,209,626 | B1 | * | 4/2001 | Bhatia | 165/104.25 |
| 6,408,937 | B1 | * | 6/2002 | Roy | 165/104.33 |

* cited by examiner

*Primary Examiner*—Terrell McKinnon

(57) ABSTRACT

A heat transfer device which employs a reciprocating mechanism for driving liquid from the heat rejection section to the heat receiving section is disclosed. The heat transfer device is coined as the reciprocating-mechanism driven heat loop which comprises a hollow loop having an interior flow passage, an amount of heat-carrying fluid filled within the loop, and at least one reciprocating driver. The hollow loop has at least one heat receiving section, one heat rejection section, and one liquid reservoir. The reciprocating driver is integrated with the liquid reservoir and facilitates a reciprocating flow of the heat-carrying fluid within the loop, so that the liquid is supplied from the heat rejection section to the heat receiving section under both saturated and unsaturated conditions and a high heat transfer rate from the heat receiving section to the heat rejection section is achieved. A substantial temperature uniformity is also attained when the air is evacuated from the loop and the heat-carrying fluid hermetically sealed within the loop is under a substantially saturated condition. Additionally, many of the heat transfer limitations associated with a heat pipe or capillary pumped loop are essentially eliminated. The embodiments of the reciprocating driver include a solenoid-operated electromagnetic driver and a bellows-type driver employing an external electromagnetic reciprocating mechanism or a mechanical reciprocating mechanism.

18 Claims, 7 Drawing Sheets

RECIPROCATING-MECHANISM DRIVEN HEAT LOOP

FIELD OF THE INVENTION

The present invention relates generally to heat transfer devices and methods. The invention can find significant applications in a wide range of industries.

BACKGROUND OF THE INVENTION

A heat transfer device utilizing a two-phase heat transfer mode is very effective in terms of the rate of heat transfer and temperature uniformity. Such a heat transfer device typically comprises an evaporator section where vaporization of the heat-carrying fluid hermetically sealed within the device occurs through the heat transfer from an external heat source into the heat transfer device, and a condenser section where the vapor generated in the evaporator is condensed into liquid through the heat transfer out of the heat transfer device to an external heat sink. The heat transfer device requires a driving mechanism for returning the liquid back to the evaporator from the condenser. Since the liquid within the two-phase heat transfer device is substantially saturated, a conventional pump would encounter the so called cavitation problem, which would prevent the pump from creating a pressure head for circulating the liquid within the heat transfer device. Subsequently, the utilization of a conventional pump in a two-phase heat transfer device is rare unless the size of the heat transfer device is sufficiently large and a sufficient sub-cooling of the liquid at the inlet of the pump can be maintained.

Since the invention of the heat pipe by Grover in 1963 (U.S. Pat. No. 3,229,759), the heat pipe has been studied extensively as a two-phase heat transfer device. Although the heat pipe originally invented by Grover employs the capillary action of a wick structure as the driving force for returning the condensate from the condenser (heat rejection section) to the evaporator (heat receiving section), several other driving forces were also employed. These driving forces that have found significant applications include centrifugal forces (rotating heat pipes) and gravitational force (gravity-assisted heat pipes). In addition, the capillary pumped loop or capillary pumped heat pipe which requires a capillary wick structure only in the evaporator section has also been developed. Although the capillary-wick based heat pipe has found substantial applications especially in aerospace undertakings such as satellite isothermalisation, and the gravity-assisted heat pipe has found significant terrestrial applications such as those in heat recovery units, their performance is not without problems. The magnitude of the capillary pumping action is usually small and is limited by the pressure difference across the menisci in the capillaries. As a result, the heat pipe or capillary pumped loop has difficulty in handling applications involving a high heat flux/high power input. Additionally, the reliability of the wick structure is a major concern. The pumping force in a gravity-assisted heat pipe is also relatively weak and is limited to a maximum 1 G acceleration. Furthermore, the gravity-assisted heat pipe is limited to the terrestrial applications where the gravitational head is available.

Cao and Wang (U.S. Pat. No. 5,454,351, Engine Piston, 1996) developed a reciprocating heat pipe which has a heat transfer mechanism different from those of traditional heat pipes. The reciprocating heat pipe is attached to an axially reciprocating mechanism, such as a slider-crank mechanism of an internal combustion engine, cam-follower mechanism, offset slider-crank mechanism, harmonic motion mechanism, or Scotch yoke mechanism. During the operation, the heat pipe experiences the same reciprocating motion as that of the reciprocating mechanism, which creates a reciprocating motion of the liquid within the heat pipe relative to the heat pipe container. This reciprocating motion of the liquid inside the heat pipe effectively returns the liquid condensate from the condenser section to the evaporator section. The collision of the liquid with the heat pipe interior wall and the rapid mixing of the heat-carrying fluid in the heat pipe also significantly enhance the heat transfer within the heat pipe. The reciprocating heat pipe substantially eliminates the aforementioned heat transfer limitations associated with the heat pipe and produces a substantially uniform temperature distribution along the heat pipe length even under a high heat loading condition in the evaporator section. The application of the reciprocating heat pipe, however, is substantially limited to the heat transfer of a reciprocating element. Since most heat transfer applications involve non-reciprocating elements, the applicability of the reciprocating heat pipe concept is rather limited.

SUMMARY OF THE INVENTION

It is therefore an object of the present invention to provide a heat transfer device which attains a reciprocating motion of the heat-carrying fluid inside the heat transfer device under both saturated and unsaturated conditions without requiring a reciprocating motion of the entire heat transfer device, so that the application of the heat transfer device will not be limited to reciprocating elements. The present invention also provides a novel fluid pumping mechanism for heat transfer purposes. Said heat transfer device is coined as the reciprocating-mechanism driven heat loop which comprises a hollow loop having an interior flow passage, an amount of heat-carrying fluid filled within the loop, and a reciprocating driver. The heat loop has at least a heat receiving section, a heat rejection section, and a liquid reservoir. Said reciprocating driver is integrated with the liquid reservoir and facilitates a reciprocating flow of the heat-carrying fluid within the heat loop, thereby, liquid is supplied from the heat rejection section to the heat receiving section under both saturated and unsaturated conditions and a high heat transfer rate from the heat receiving section to the heat rejection section is achieved. A substantial temperature uniformity is also attained when the air is evacuated from the loop and the heat-carrying fluid hermetically sealed within the loop is under a substantially saturated condition. Furthermore, many of the heat transfer limitations associated with a heat pipe or capillary pumped loop are essentially eliminated. Since the heat loop is uniquely associated with a reciprocating flow in the loop, the reciprocating-mechanism driven heat loop is also referred to as the reciprocating-flow heat loop.

According to a preferred embodiment of the present invention, the reciprocating driver is a solenoid-operated electromagnetic driver. The electromagnetic driver comprises a pair of solenoids which are disposed outside the casing of the liquid reservoir in an axial direction of the reservoir, and a piston of magnetic metal disposed inside the reservoir movably in an axial direction of the reservoir. When the circuits of the two solenoids are opened and closed alternately opposite to each other, a reciprocating motion of the piston is induced, which in turn produces a reciprocating flow of the heat-carrying fluid within the heat loop. Because of the relatively large reciprocating stroke of the piston and the relatively large volume of the reservoir compared to the remainder of the interior volume of the loop, the liquid is effectively supplied from the heat rejection section to the heat receiving section of the reciprocating heat loop.

According to another preferred embodiment of the invention, the reciprocating driver is a bellows-type driver employing an external reciprocating mechanism. In this case, part of or substantially entire casing of the liquid reservoir is a bellows. A partition is disposed near the mid section of the bellows, said partition is transverse to the longitudinal axis of the bellows and essentially divides the bellows and the liquid reservoir into two segments. The partition is coupled with an external reciprocating mechanism through a connecting rod, said external reciprocating mechanism can be a solenoid-operated electromagnetic reciprocating mechanism or a mechanical reciprocating mechanism. When the external reciprocating mechanism is in operation, the partition would experience a reciprocating motion along with the bellows, thereby a reciprocating flow of the heat-carrying fluid inside the reciprocating heat loop is effectively produced, and liquid is effectively supplied from the heat rejection section to the heat receiving section of the reciprocating heat loop.

DETAILED DESCRIPTIONS OF THE INVENTION

Figure 1:
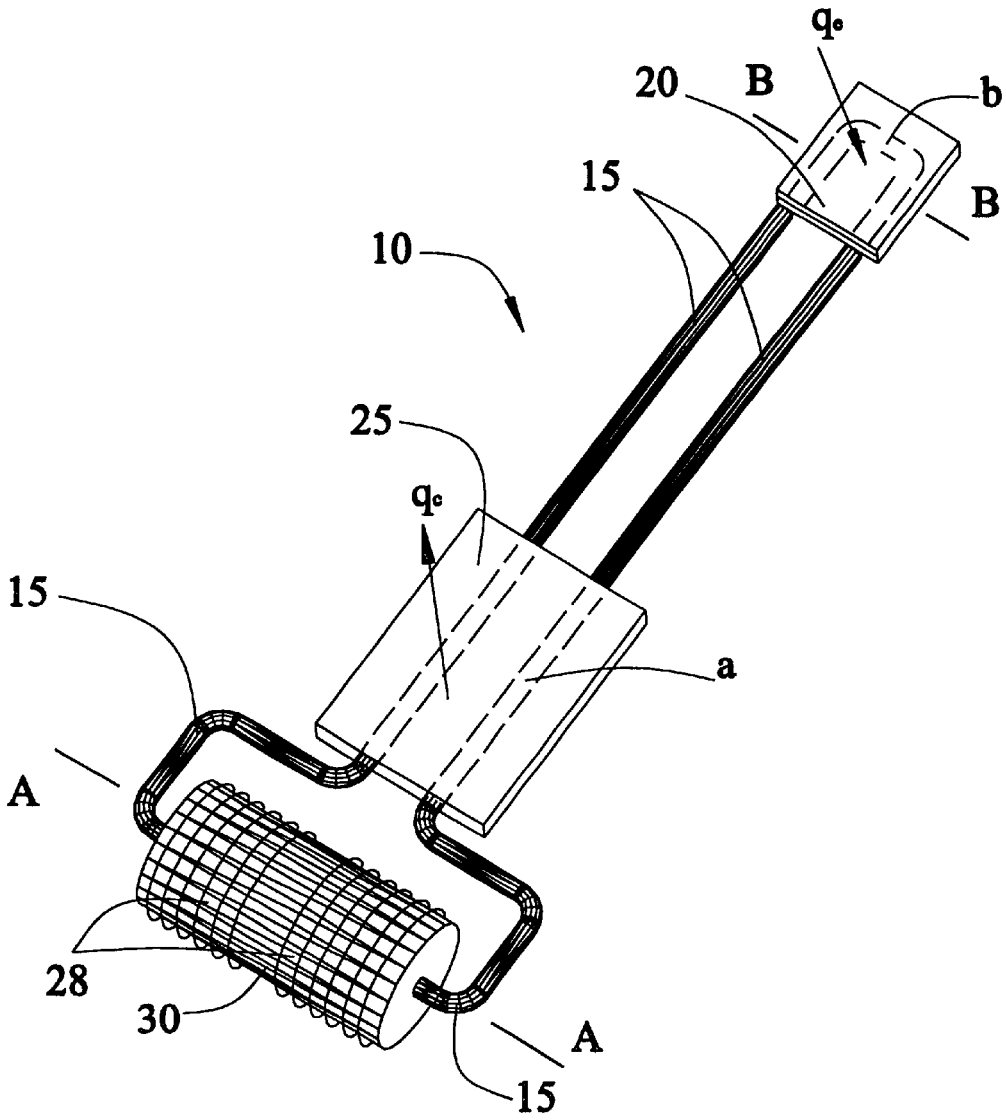
FIG. 1 is a schematic drawing of a reciprocating-mechanism driven heat loop in accordance with the present invention.

Referring now to FIG. 1, a reciprocating-mechanism driven heat loop 10 is schematically illustrated which is constructed in accordance with the principles of the present invention. The reciprocating loop generally comprises a hollow loop 15 having an interior flow passage. The hollow loop 15 is filled with an amount of heat-carrying fluid as the working fluid with a sufficient fraction of the total interior volume of the loop being occupied by liquid, and a heat receiving section 20, where a heat transfer rate $q_e$ is applied to the loop, a heat rejection section 25, where a heat transfer rate $q_c$ is transferred out of the loop, a liquid reservoir 30, and a reciprocating driver 28. The reciprocating driver 28 is integrated with the liquid reservoir 30 and facilitates a reciprocating motion of the heat-carrying fluid within the loop, so that the liquid is supplied from the heat rejection section to the heat receiving section of the heat loop under both saturated and unsaturated conditions. Furthermore, the rapid mixing of the heat-carrying fluid within the heat loop due to the reciprocating motion of the fluid plays an important role in enhancing the heat transfer in the loop. As a result, a high heat transfer rate from the heat receiving section (or evaporator section) to the heat rejection section (or the condenser section) is achieved through the operation of the reciprocating driver. A substantial temperature uniformity is also attained when the air is evacuated from the loop and the loop is hermetically sealed so that the heat-carrying fluid within the loop is substantially under a saturated condition.

Figure 2:
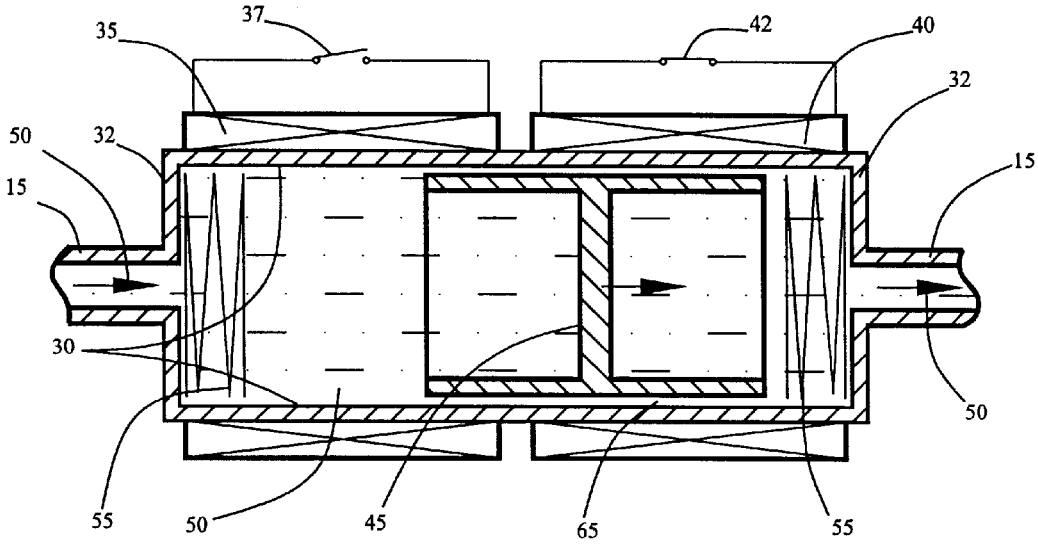
FIG. 2 is a schematic axial cross-sectional view of an electromagnetic driver taken on line A—A in FIG. 1 when the circuit of the right-hand solenoid is closed and the circuit of the left-hand solenoid is opened.

A preferred embodiment of the reciprocating driver is a solenoid-operated electromagnetic driver which is schematically shown in FIG. 2. The electromagnetic driver comprises a pair of solenoids 35 and 40 which are disposed outside the liquid reservoir 30 in an axial direction of the reservoir, and a piston 45 disposed movably in the axial direction of the reservoir inside the reservoir. The piston 45 is made of a magnetic metal. When the circuits of the two solenoids are alternately closed and opened opposite to each other, a reciprocating motion of the piston 45 is induced. In the case shown in FIG. 2, the circuit of solenoid 40 is closed through a switch 42 while the circuit of the solenoid 35 is opened through a switch 37. As a result, the piston 45 is being attracted towards the right end of the liquid reservoir through the magnetic field generated by the solenoid 40. Because the liquid reservoir 30 has a substantially larger inner diameter than that of the loop tubing 15 (or the volume of the reservoir is large compared to the remainder of the interior volume of the loop) and a sufficient fraction of the interior volume of the loop is occupied by liquid, a counterclockwise flow of the heat-carrying fluid 50 is produced within the loop. With a sufficiently large piston stroke, liquid is effectively supplied to the heat receiving section (or the evaporator section) from the heat rejection section (or the condenser section).

Figure 3:
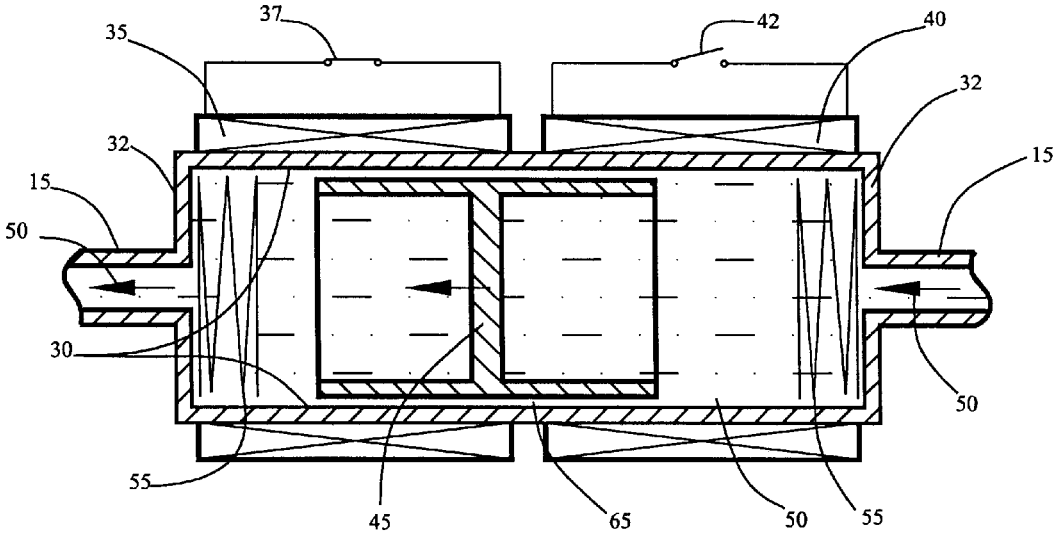
FIG. 3 is a schematic axial cross-sectional view of an electromagnetic driver taken on line A—A in FIG. 1 when the circuit of the left-hand solenoid is closed and the circuit of the right-hand solenoid is opened.

FIG. 3 illustrates the same electromagnetic driver as shown in FIG. 2 when the switch 37 of the solenoid 35 is closed while the switch 42 of the solenoid 40 is opened. In this case, the piston 45 stops being attracted by the right-hand solenoid 42 and is attracted by the left-hand solenoid 35 towards the left, and a clockwise flow of the heat-carrying fluid within the loop is produced. With an alternate on-and-off of the switches 37 and 42 opposite to each other, a reciprocating flow of the heat carrying-fluid enclosed within the loop is created. The reciprocating frequency of the piston 45 as well as the power supplies to the solenoids 35 and 40 can be controlled through an integrated circuit, which can adjust the frequency and power supplies based on the heating condition in the heat receiving section, cooling condition in the heat rejection condition, or the temperature distribution around the loop.

The gap 65 between the outer surface of the piston 45 and the inner surface of the reservoir casing should be sufficiently small so that the back flow (from the right compartment of the reservoir to the left compartment of the reservoir when the piston moves towards the right or from the left compartment of the reservoir to the right compartment of the reservoir when piston move towards the left) is substantially prevented, so that the fluid can be effectively driven reciprocatingly by the piston. However, the gap 65 should not be too small so that a free sliding condition between the piston and the reservoir casing is maintained. Additionally, to reduce the kinetic energy losses and possible noise associated with possible collisions between the piston 45 and the side walls 32 of the reservoir when the piston reaches the right dead center or the left dead center, a spring 55 can be disposed proximate each side wall 32 of the reservoir.

The heat loop described herein emphasizes a two-phase heat transfer mode when the heat-carrying fluid is substantially saturated for applications involving high heat transfer rates or with a temperature uniformity requirement. In this case, liquid can be driven from the condenser section to the evaporator section without encountering the cavitation problem as faced by a conventional pump, or without being limited by the capillary limit as encountered by a heat pipe or capillary pumped loop. However, for a single-phase heat transfer mode, the present invention is also advantageous. Since the fluid flow from the heat rejection section to the heat receiving section constantly changes directions (alternately clockwise and counterclockwise), the boundary layers that would otherwise be developed at the heating or cooling surface are essentially eliminated. Therefore, the heat transfer of a reciprocating-mechanism driven heat loop working in a single-phase mode could be more effective than that of a conventional forced convection configuration or even a liquid impingement configuration.

A working criterion based upon the geometry of a reciprocating-mechanism driven heat loop shown in FIG. 1 for both two-phase and single phase heat transfer has been derived and is given as follows:

$$A_p S \geq 2\left(\frac{V_{eff}}{2}\right)\phi \tag{1}$$

where $A_p$ is the cross-sectional area of the piston;

S is the reciprocating stroke of the piston;

$A_pS$ is the displacement volume of the piston in one stroke;

$V_{eff}/2$ is the portion of the interior volume of the heat loop from the center of the heat rejection section a to the center of the heat receiving section b as shown in FIG. 1;

$V_{eff}$ is the effective displacement volume of the heat loop; and $\phi$ is the effective liquid fraction between the heat rejection section and heat receiving section. For a single-phase heat transfer mode, $\phi=1$.

The condition upon which the above relation is derived is that the liquid at the center of the heat rejection section should be able to reach the center of the heat receiving section when the reciprocating driver is in operation. Although the above relation is derived based on a specific heat loop geometry and some assumptions including neglecting the back flow between the piston outer surface and reservoir inner surface, it provides a concise guidance for a heat loop design. The important geometric parameters of a heat loop is the heat transfer distance and the average interior cross-sectional area between the heat receiving and heat rejection sections, which together gives the effective displacement volume of the heat loop. The liquid displacement volume as represented by $A_pS$ should satisfy equation (1) in order for the heat loop to work properly according to the present model upon which equation (1) is derived. During the operation of the heat loop, the liquid reservoir is preferably containing a liquid. However, when the heat-carrying fluid is saturated, the liquid reservoir could contain a liquid-vapor two-phase mixture. In this case, the term $A_pS$ in equation (1) may need to be multiplied by a factor that is less than unity.

Figure 4:
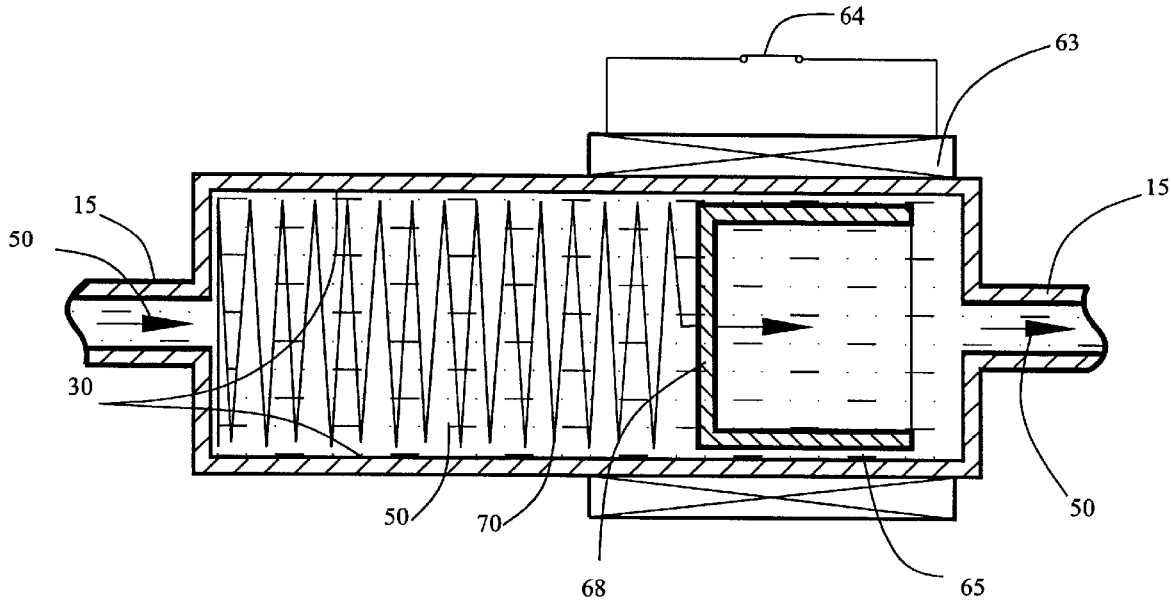
FIG. 4 is a schematic axial cross-sectional view of an electromagnetic driver taken on line A—A in FIG. 1 with a single solenoid configuration.

Another embodiment of the reciprocating driver is an electromagnetic driver with a single solenoid configuration, as shown in FIG. 4. In this configuration, a solenoid 63 is disposed towards one end of the liquid reservoir, say, towards the right end of the reservoir, as shown in FIG. 4. A piston 68 is mounted to one end of a spring 70 with the other end of the spring mounted to the left end of the reservoir. When the switch 64 of the solenoid 63 is closed, the piston 68 is attracted towards the right end of the reservoir and a counterclockwise flow of the heat-carrying fluid within the loop is produced. When the switch 64 is opened and the piston 68 stops being attracted by the solenoid 63, the piston is pulled back by the spring towards the left end of the reservoir, so that a clockwise flow of the heat-carrying fluid within the loop is produced (not shown here). Alternatively, the solenoid 63 may be disposed towards the left end of the reservoir and the spring may not be attached to the piston or to the end of the reservoir. With the switch 64 being turned on and off alternately, a similar reciprocating motion of the piston can be generated (not shown here). Compared to the embodiment employing a pair of solenoids as shown in FIG. 2, the embodiment in FIG. 4 has the advantage of simplicity and energy conservation. However, it could have difficulty in producing a large piston reciprocating stroke due to the limitation of the spring characteristics.

Figure 5:
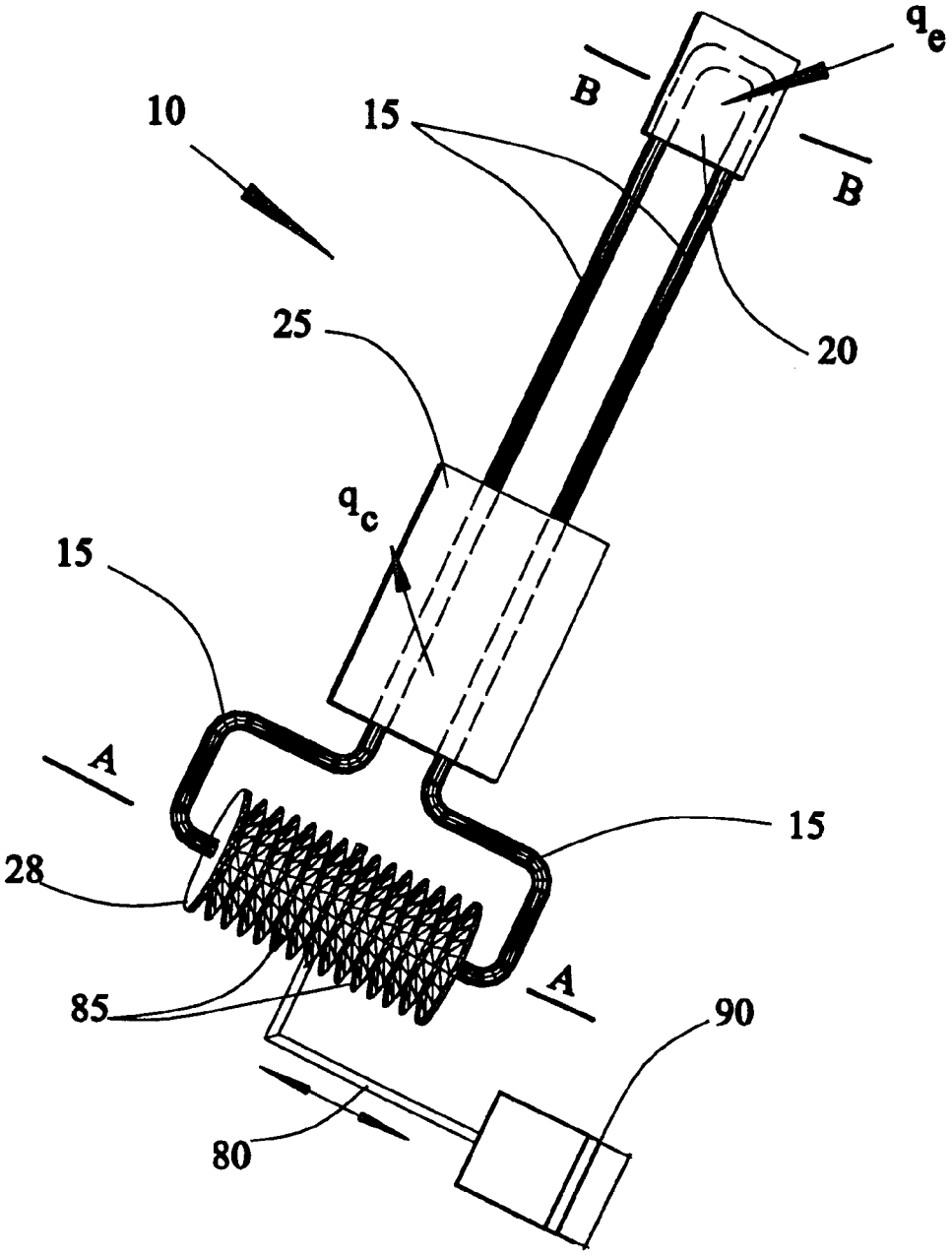
FIG. 5 is a schematic drawing of a heat loop having a bellows-type reciprocating driver employing an external reciprocating mechanism, in accordance with the present invention.
Figure 6:
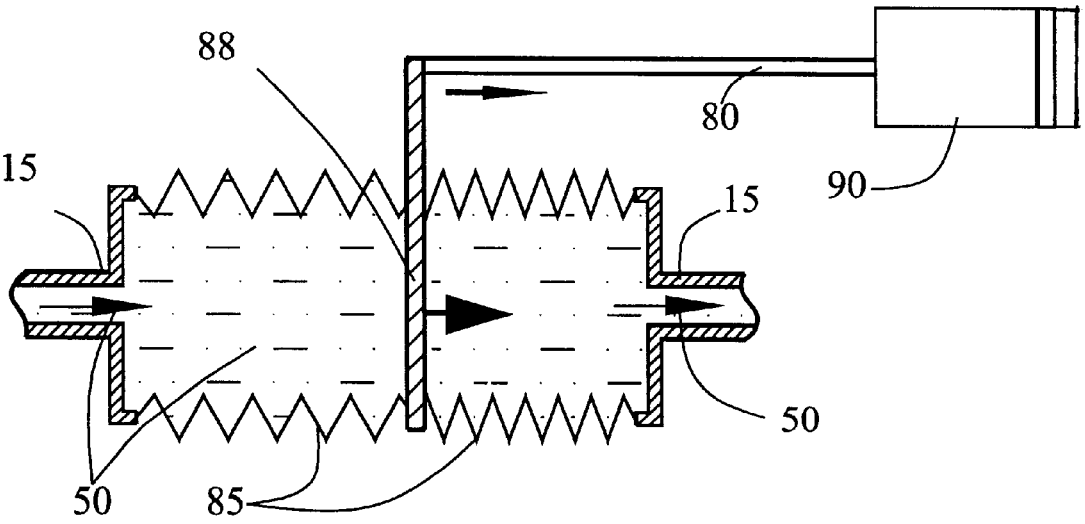
FIG. 6 is a schematic axial cross-sectional view of a bellows-type reciprocating driver taken on line A—A in FIG. 5 when the partition of the bellows is pulled by the reciprocating mechanism towards the right.

According to another embodiment of the present invention, the reciprocating-mechanism driven heat loop incorporates a bellows-type driver employing an external reciprocating mechanism, as shown in FIG. 5. Through a connecting rod 80, the bellows 85 is coupled with a reciprocating mechanism 90 which could produce a reciprocating motion with a sufficiently large reciprocating stroke. A detailed description of the aforementioned bellows-type driver is schematically illustrated in FIG. 6. In this case, part of or substantially entire circumferential casing of the liquid reservoir is a bellows 85. A partition 88 is disposed near the mid section of the bellows. The partition 88 is transverse to the longitudinal axis of the bellows and essentially divides the bellows and the liquid reservoir into two segments. The partition 88 is coupled with an external reciprocating mechanism 90 through a connecting rod 80. When the external reciprocating mechanism is in operation, a reciprocating motion of the partition is produced through the coupling with the reciprocating mechanism. When the partition 88 is moving towards the right, as shown in FIG. 6, it drives the heat-carrying fluid to flow towards the right and a counterclockwise flow of the heat-carrying fluid within the heat loop is produced. In this case, the bellows segment on the right is compressed and the bellows segment on the left is stretched. No motion of the heat loop is required except for the bellows itself. When the connecting rod changes the direction and the partition 88 moves from the right to the left, the partition 88 would drive the heat carrying fluid to flow towards the left and a clockwise flow of the heat-carrying fluid within the loop is produced (not shown here). As a result, a reciprocating flow of the heat-carrying fluid enclosed within the loop is generated. Similar to the cases where an electromagnetic driver is employed, with a sufficiently large reservoir volume and a sufficiently large reciprocating stroke of the partition 88 as well as a sufficient liquid fill within the loop, the liquid is effectively supplied from the heat rejection section to the heat receiving section of the heat loop. The aforementioned external reciprocating mechanism can be a solenoid-operated electromagnetic driver or a mechanical reciprocating mechanism driven by an electric motor. The mechanical reciprocating mechanism can be a slider-crank mechanism similar to that of an internal combustion engine, cam-follower mechanism, offset slider-crank mechanism, harmonic motion mechanism, or Scotch yoke mechanism. These and other mechanical reciprocating mechanisms have been described in detail by Ling et al. (Ling et al., "Critical working frequency of reciprocating heat-transfer devices in axially reciprocating mechanisms," *International Journal of Heat Mass Transfer*, Vol. 41, No. 1, 1998, pp. 73–80) and other prior arts. A reciprocating-mechanism driven heat loop employing a bellows-type driver has the advantages over that employing an electromagnetic driver when the working temperature of the heat loop is high and the space surrounding the liquid reservoir is limited. Additionally, during the operation of the bellows-type driver, the outer surface of the bellows itself can serve as a heat rejection surface, which is especially attractive when a gas is used as a coolant of the heat loop. In this case, however, the liquid reservoir could contain substantially a two-phase mixture of liquid and vapor when the heat loop is working in a two-phase heat transfer mode.

Figure 7:
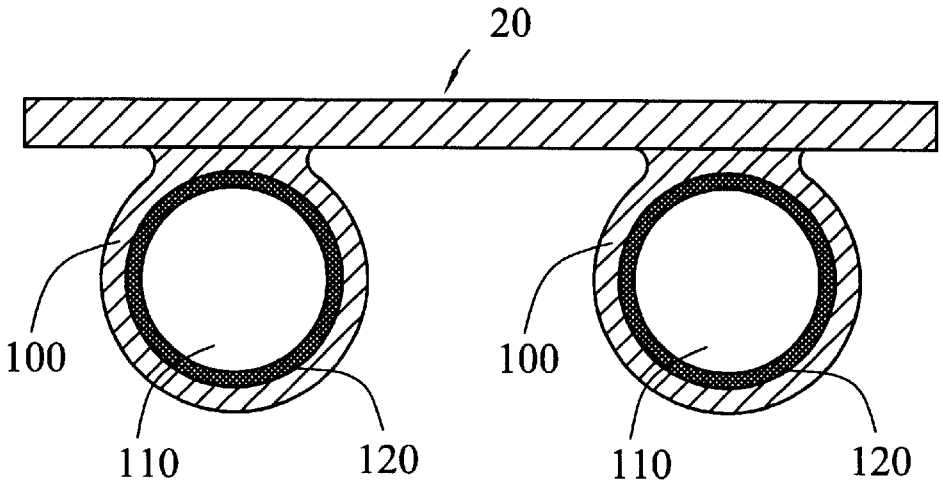
FIG. 7 is a cross-sectional view of the heat receiving section taken on line B—B in FIG. 1, showing a liquid retaining mechanism disposed at the inner surface of the hollow loop in the heat receiving section of the heat loop.

When a reciprocating-mechanism driven heat loop is working under a two-phase saturated condition, the liquid consumption in the evaporator section of the loop is relatively small if the heat-carrying fluid has a large latent heat of vaporization and the heat input to the evaporator section is not too high. In this case, a liquid retaining mechanism can be provided in the evaporator section of the heat loop and the reciprocating driver can work intermittently to reduce the power consumption of the reciprocating driver. Common liquid retaining mechanisms include porous structures, grooves, pin fins as well as many other commonly known liquid retaining mechanisms described in prior arts. FIG. 7 is a cross-sectional view of the evaporator section 20 taken on line B—B in FIG. 1 or FIG. 5, showing loop container 100, flow passage 110, and a liquid retaining mechanism 120 disposed at the inner surface of the loop container 100. Generally, a liquid retaining mechanism is needed only in the evaporator section and when the power consumption of the reciprocating driver is a major concern.

Figure 8:
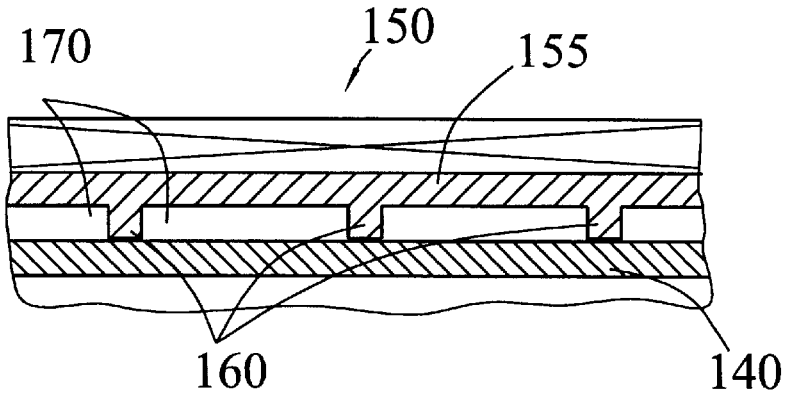
FIG. 8 is a schematic sectional view of a solenoid, showing a special contact arrangement with the reservoir casing to reduce the heat transfer from the solenoid into the reservoir.

The energy needed to produce a reciprocating flow of the heat-carrying fluid in an electromagnetic-driver based heat loop is provided through the conversion of electrical energy into mechanical energy. The conversion efficiency of the electrical energy to the mechanical energy is definitely less than unity and a certain amount of the electrical energy is dissipated into heat in the solenoid. If a substantial amount of this dissipated heat is transferred into the reservoir, the efficiency of the reciprocating driver will be reduced. FIG. 8 is a sectional view of a solenoid 150, showing a special contact arrangement with the reservoir casing 140 to reduce the heat transfer from the solenoid into the reservoir. As illustrated in the figure, the solenoid shell 155 contacts the reservoir casing 140 only at some discrete locations 160, and a gap 170 that separates the solenoid from the casing exists along a substantially large portion of the longitudinal dimension of the reservoir. Due to the existence of the gap, the thermal resistance between the solenoid and the reservoir casing is substantially increased and the heat transfer into the reservoir is significantly reduced.

Figure 9:
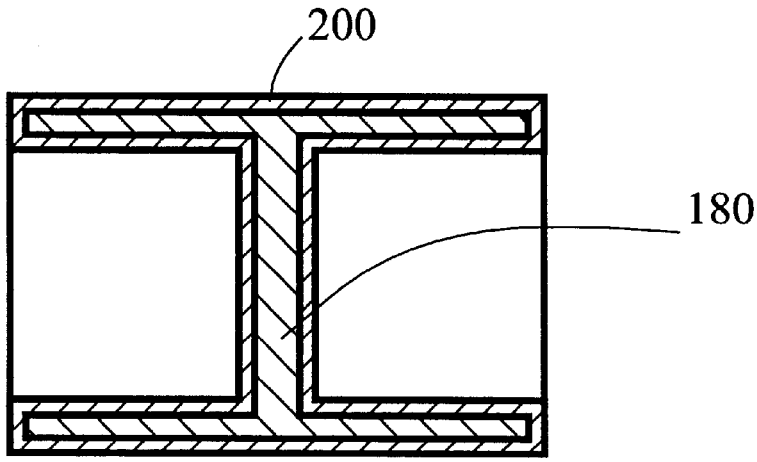
FIG. 9 is a schematic axial cross-sectional view of a composite piston associated with an electromagnetic driver.

As mentioned earlier, the piston is made of a magnetic metal. In some situations, however, a piston material may be chemically incompatible with the heat-carrying fluid enclosed within the heat loop. Chemical reactions between the heat-carrying fluid and the piston material or decomposition of the heat-carrying fluid may lead to the generation of non-condensable gas or corrosion. When the heat loop is working in a two-phase saturation mode, the existence of the non-condensable gas would result in a substantial non-uniformity of the temperature distribution around the loop and significantly reduce the heat transfer effectiveness from the heat receiving section to the heat rejection section. In this case, a composite piston can be used. FIG. 9 is a cross-sectional view of a composite piston associated with an electromagnetic driver. The composite piston comprises a core of magnetic material 180 and a coating 200 on the outer surface of the core. The material of the coating is selected such that it is substantially compatible with the heat-carrying fluid enclosed within the loop. When water is used as the heat-carrying fluid, for instance, a preferred material for the coating is copper which is substantially compatible with water. Techniques that could be used to create the coating include electroplating and molding if a thicker coating is desired.

Figure 10:
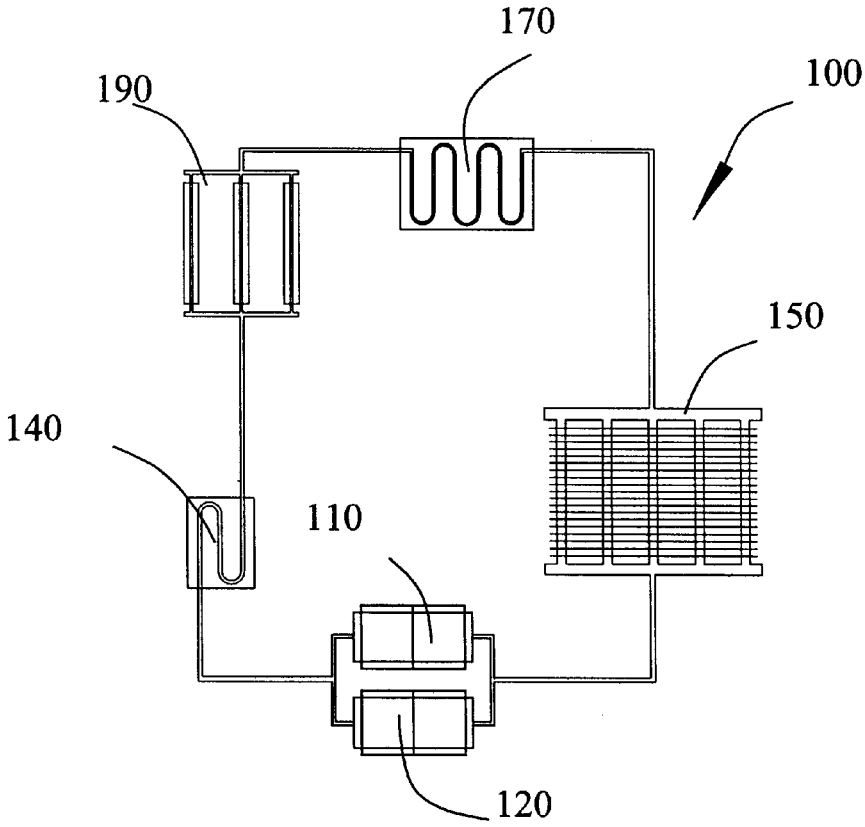
FIG. 10 is a schematic drawing of a reciprocating-mechanism driven heat loop employing multiple reciprocating drivers in accordance with the present invention.

When the distance between the heat receiving section and the heat rejection section of the heat loop is long or multiple heat receiving sections and (or) heat rejection sections are needed, a large heat loop is required. In this case, the liquid displacement capacity of a reciprocating driver may not be large enough to facilitate the liquid supply from the heat rejection section (sections) to the heat receiving section (sections). To overcome this difficulty, multiple reciprocating drivers can be used. FIG. 10 shows a reciprocating-mechanism driven heat loop 100 employing multiple reciprocating drivers in accordance with the present invention. Reciprocating driver 110 and reciprocating driver 120 are connected in parallel and operate in synchronism to produce a reciprocating flow of the heat-carrying fluid within the loop. Multiple heat receiving sections and multiple heat rejection sections can also be deployed in the loop as indicated in FIG. 10. The layout of the heat loop is also flexible. In additional to a heat rejection section 140 similar to that in the previous drawings, a heat rejection section 150 employing parallel flow channels with flow headers can be deployed. Fins can be used when air is used as the coolant as indicated in the heat rejection section 150. Similarly, in addition to a heat receiving section 170 similar to that in the previous drawings, a heat receiving section 190 which accommodates multiple heat sources can be deployed. Many other heat receiving or heat rejection sections commonly known in the prior arts can also be deployed in the heat loop (not shown here). These heat receiving/heat rejection sections could employ conduction, convection, or radiation as the heat exchange mode with an external heat source or heat sink, and utilize a gas or liquid as the heat transfer medium between the heat loop and the external heat source or heat sink for convection heat transfer.

It will thus be seen that the invention effectively attains the objectives set forth above. It is intended that all matter contained in the above specification or shown in the accompanying drawings be interpreted as illustrative and not in a limiting sense. Any changes, modifications, and variations of the subject invention will be apparent to those skilled in the art after considering this specification together with the accompanying drawings.

What is claimed is:

1. A reciprocating-mechanism driven heat loop comprises:

a hollow loop having an interior flow passage, said loop having at least one heat receiving section where heat is transferred into said loop from an external heat source, one heat rejection section where heat is transferred out of said loop to an external heat sink, and one fluid reservoir;

an amount of heat-carrying fluid filled within said loop;

and at least one reciprocating driver, said reciprocating driver being integrated with said fluid reservoir and producing a reciprocating flow of said heat-carrying fluid within said loop, thereby liquid is effectively supplied to said heat receiving section in a non-unidirectional manner under both saturated and unsaturated conditions.

2. The invention as described in claim 1, wherein air is evacuated from said heat loop and said heat-carrying fluid is hermetically sealed within said heat loop.

3. The invention as described in claim 1, wherein a liquid retaining mechanism is provided in said heat receiving section.

4. The invention as described in claim 1, wherein said reciprocating drivers are connected in parallel and operate in synchronism when more than one reciprocating driver is employed in said reciprocating-mechanism driven heat loop.

5. The invention as described in claim 1, wherein said reciprocating driver is a solenoid-operated reciprocating driver, said solenoid-operated driver comprising a pair of solenoids disposed outside of said fluid reservoir in an axial direction of said reservoir, and a piston of magnetic metal disposed inside of said reservoir and movably in an axial direction of said reservoir, thereby, when the circuits of said two solenoids are opened and closed alternately opposite to each other, a reciprocating motion of the piston is induced, and thereby a reciprocating flow of said heat-carrying fluid is produced within said heat loop.

6. The invention as described in claim 1, wherein said reciprocating driver is a solenoid-operated reciprocating driver, said solenoid-operated driver comprising a solenoid disposed outside of said fluid reservoir in an axial direction of said reservoir and furthermore towards one end of said reservoir, a spring disposed inside of said reservoir and proximate one end of said reservoir, and a piston of magnetic metal disposed inside of said reservoir and movably in an axial direction of said reservoir, thereby, when the circuit of said solenoid is opened and closed alternately, a reciprocating motion of said piston is induced, and thereby a reciprocating flow of said heat-carrying fluid is produced within said heat loop.

7. The invention as described in claim 5, wherein said piston is a composite piston, said composite piston comprising a piston core being made of a magnetic metal and a coating outside of said piston core, said coating is made of a material chemically compatible with said heat-carrying fluid, so that the possible chemical reaction between said piston and said heat-carrying fluid is substantially reduced.

8. The invention as described in claim 6, wherein said piston is a composite piston, said composite piston comprising a piston core being made of a magnetic metal and a coating outside of said piston core, said coating being made of a material chemically compatible with said heat-carrying fluid, so that the possible chemical reaction between said piston and said heat-carrying fluid is,substantially reduced.

9. The invention as described in claim 5, wherein said solenoids contact the casing of said reservoir only at some discrete locations with substantially large portion of the solenoid surface which faces said reservoir casing spaced from said reservoir casing, thereby the heat transfer from said solenoids into said reservoir is significantly reduced.

10. The invention as described in claim 6, wherein said solenoid contacts the casing of said reservoir only at some discrete locations with substantially large portion of the solenoid surface which faces said reservoir casing spaced from said reservoir casing, thereby the heat transfer from said solenoid into said reservoir is significantly reduced.

11. The invention as described in claim 1, wherein said reciprocating driver is a bellows-type driver employing an external reciprocating mechanism, said bellows-type driver comprising a bellows, said bellows constituting a substantial portion of the casing of said fluid reservoir, a partition essentially dividing said reservoir and said bellows into two segments, and an external reciprocating mechanism, said external reciprocating mechanism being coupled with said partition, thereby, during the operation of said external reciprocating mechanism, a reciprocating motion of said partition is created and thereby a reciprocating flow of said heat-carrying fluid within said heat loop is produced.

12. The invention as described in claim 11, wherein said external reciprocating mechanism is a solenoid-operated electromagnetic reciprocating mechanism.

13. The invention as described in claim 11, wherein said external reciprocating mechanism is a slider-crank mechanical reciprocating mechanism.

14. The invention as described in claim 11, wherein said external reciprocating mechanism is a cam-follower mechanical reciprocating mechanism.

15. The invention as described in claim 11, wherein said external reciprocating mechanism is an offset slider-crank mechanical reciprocating mechanism.

16. The invention as described in claim 11, wherein said external reciprocating mechanism is a harmonic motion mechanical reciprocating mechanism.

17. The invention as described in claim 11, wherein said external reciprocating mechanism is a Scotch yoke mechanical reciprocating mechanism.

18. The invention as described in claim 11, wherein the external surface of said bellows is cooled by a coolant.

* * * * *